United States Patent [19]

Andress, Jr. et al.

[11] Patent Number: 4,698,169

[45] Date of Patent: Oct. 6, 1987

[54] REACTION PRODUCTS OF ALKENYLSUCCINIC COMPOUNDS WITH AROMATIC AMINES AND LUBRICANT COMPOSITIONS THEREOF

[75] Inventors: Harry J. Andress, Jr., Wenonah; Henry Ashjian, E. Brunswick, both of N.J.

[73] Assignee: Mobil Oil Corporation, New York, N.Y.

[21] Appl. No.: 858,406

[22] Filed: May 1, 1986

[51] Int. Cl.[4] ..... C10M 133/44; C10M 139/00

[52] U.S. Cl. ..... 252/49.6; 252/51.5 A; 558/291; 558/294; 548/405; 548/545

[58] Field of Search ..... 252/49.6, 51.5 A; 548/405, 545; 558/291, 294

[56] References Cited

U.S. PATENT DOCUMENTS

| | | | |
|---|---|---|---|
| 4,119,552 | 10/1978 | Davis et al. | 252/49.6 |
| 4,173,540 | 11/1979 | Lonstrup et al. | 252/49.6 |
| 4,617,137 | 10/1986 | Plavac | 252/49.6 |
| 4,629,577 | 12/1986 | Liston | 252/49.6 |
| 4,629,578 | 12/1986 | Liston | 252/49.6 |
| 4,636,322 | 1/1987 | Nalesnik | 252/51.5 A |

*Primary Examiner*—Jacqueline V. Howard
*Attorney, Agent, or Firm*—A. J. McKillop; M. G. Gilman; H. M. Flournoy

[57] ABSTRACT

Products made by reacting (i) an alkenylsuccinic compound with (ii) an arylamine and (iii) an alkanolamine, an aminomethane or a hindered alcohol and borated reaction products thereof which provide superior dispersant and antioxidant activity to lubricant compositions when incorporated therein.

17 Claims, No Drawings

REACTION PRODUCTS OF ALKENYLSUCCINIC COMPOUNDS WITH AROMATIC AMINES AND LUBRICANT COMPOSITIONS THEREOF

CROSS REFERENCE TO RELATED APPLICATIONS

This application is related to copending U.S. application Ser. No. 702,989, filed Feb. 19, 1985 and entitled "Reaction Products of Alkenylsuccinic Compounds With Aromatic Amines and Hindered Alcohols and Lubricant Compositions Thereof" and to European patent application No. 85303120.1, filed May 2, 1985 entitled "Reaction Products of Alkenylsuccinic Compounds With Aromatic Amines and Lubricant Compositions Thereof", and also filed of even date in South Africa, New Zealand, Australia and also filed in Japan May 7, 1985 and in Canada May 29, 1985.

BACKGROUND OF THE INVENTION

The invention relates to additives useful in lubricant compositions having superior dispersant and antioxidant activity.

It is known that in the normal use of organic lubricant oils such as transmission fluids, bearing lubricants, power transmitting fluids and diesel engine lubricants, the base medium is subjected to oxidizing conditions which may result in the formation of sludge, lacquers, corrosive acids and the like. These products are undesirable since they leave oxidation residues or other solid contaminants which interfere with the normal operation of the fluid, increase its viscosity and even cause severe damage to parts of the equipment itself.

In the lubrication of modern engines, oil compositions must be able to prevent acids, sludge and other solid contaminants from maintaining contact with moving metal parts. Poor piston travel and excessive engine bearing corrosion may result unless the oil can prevent sludge and oxidation products from depositing in the engines. Superior dispersants are therefore particularly needed in new engine oils.

The most desirable way for decreasing these difficulties is to add to the base lubricant fluid an additive capable of dispersing solid particles to prevent them from interfering with the normal operation of the equipment and capable of leaving the metal surfaces relatively clean. Today with modern equipment operating under increasingly strenuous conditions, it is highly desirable to develop new detergents which have improved dispersant properties, which are soluble in the fluid lubricants to which they are added and which are themselves stable therein.

U.S. Pat. No. 4,219,431 is directed to lubricant compositions containing a lubricant and a minor amount of a derivative of alkenylsuccinic anhydride which includes the reaction product of (1) an alkenylsuccinic acid, ester or anhydride and a hydroxy aromatic compound and (2) the product of reaction between (1) and an amine, (3) the reaction product of (2) and an aldehyde and (4) the reaction product of (3) and a metal salt. To the best of applicants' knowledge and belief the reaction products disclosed herein are new and accordingly it is believed that no one has heretofore used the reaction product of an alkenylsuccinic compounds, e.g., anhydride, an arylamine and a hindered alcohol to provide products having superior dispersant/antioxidant charcteristics for lubricant compositions.

SUMMARY OF THE INVENTION

In accordance with the invention, there are provided (1) a product made by reacting (i) an alkenylsuccinic compound with (ii) an aromatic amine and (iii) an alkanolamine, an aminomethane or a hindered alcohol and (2) borated reaction products thereof and (3) lubricant compositions comprising a major amount of an oil of lubricating viscosity and a minor dispersant/antioxidant amount of the described reaction products or mixtures of such products. The product may also be used advantageously in liquid hydrocarbon fuels.

DESCRIPTION OF PREFERRED EMBODIMENTS

There are provided (1) a product made by (a) reacting (i) an alkenyl-succinic compound with (ii) a secondary amine of the formula:

$$\text{ANHB} \qquad \text{(I)}$$

wherein A and B, which may be the same or different, are each independently an aromatic group or an alkyl substituted aromatic group, and (b) reacting the product of step (a) with (iii) a compound selected from the group consisting of an alkanolamine of the formula:

$$(HOR^1)_xN(H)_y \qquad \text{(II)}$$

wherein $R^1$ is an alkylene group having 1 to 6 carbon atoms, x is 1 to 3 and y is 0 to 2, the sum of x and y being 3, an aminomethane of the formula:

$$(HOR^2)_{x'}C(H)_{y'}NH_2 \qquad \text{(III)}$$

wherein $R^2$ is the same as $R^1$ and x' and y' have the same meaning as x and y, respectively, and a hindered alcohol selected from the group having the following general formulae:

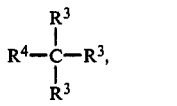

(IV)

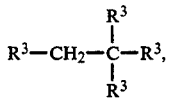

(V)

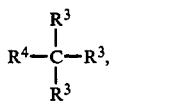

(VI)

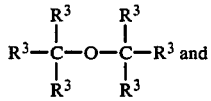

(VII)

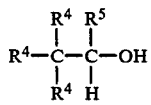

(VIII)

wherein $R^3$ and $R^4$ are each independently selected from CHOH, $CH_2OH$ and $CH_3$ and $R^5$ is selected from H or an alkyl group of from about 4 to 22, preferably about 5 carbon atoms and (2) a lubricant composition comprising a major amount of a lubricant and a minor dispersant/antioxidant amount of the described reaction product (1). The reaction products may be optionally borated. The reaction product may also be used in liquid hydrocarbon fuels.

The alkenylsuccinic compound (i) which includes alkenylsuccinic acid, ester or anhydride thereof is one wherein the alkenyl group is a hydrocarbon containing a double bond and containing from 25 to about 300, preferably 30 to 150 carbon atoms. The alkenyl group can have a number average molecular weight of from about 360 to about 1800. An oligomer may be produced by known techniques from an olefin or polyolefin and maleic anhydride such as the catalytic oligomerization of an olefin containing 2 to about 10 carbon atoms and the oligomer so produced can then be reacted with maleic anhydride by well known methods (as by $BF_3$ catalysis) to give the alkenylsuccinic compound. The olefin may be a simple alkene, such as 1-octene, 1-decene, 1-dodecene, and so forth, or it may be a polymer or copolymer of such olefins as ethene, propene, 1-butene, isobutene, 1-hexene, 1-octene and so forth.

The alkenylsuccinic esters include the mono and diesters and may be represented by the formula:

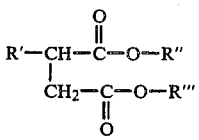

(IX)

wherein R′ is the alkenyl group defined hereinabove and R″ and R‴ are hydrogen or a hydrocarbyl group having from 1 to 22 carbon atoms. Preferably the group is an alkyl having 1 to 18 carbon atoms. For example, R″ and R‴ may be methyl, ethyl, butyl, octyl, dodecyl, octadecyl, eicosyl, and the like. They may also be hydrogen. While both R″ and R‴ may be a hydrocarbyl group, either the same or different, only one of them may be hydrogen. In other words, at least one of R″ and R‴ must be a hydrocarbyl group.

Preferred secondary aromatic amines of the above formula A-NH-B (I) include secondary aromatic amines of the formulas:

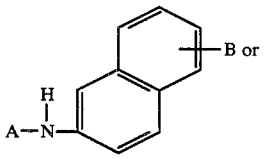

(I′)

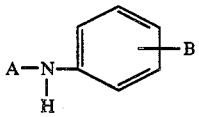

(I″)

wherein A and B are each an aromatic or aryl group which may be the same or different, and which may contain an aliphatic substituent, preferably an alkyl substituent having 1 to 44, preferably about 4 to 18 carbon atoms; each aryl group (A and B) separately may be a benzene or naphthalene nucleus, containing substituents in addition to the alkyl groups. A and/or B may, for example, be a naphthalene residue such as an alpha or beta naphtyl group. The aromatic or aryl groups generally will have from 6 to about 50 carbon atoms, preferably 6 to 14 carbon atoms. In addition to being alkyl, substituent groups may also be an aralkyl, alkoxy or acyloxy group. However, preferably the substituent will be selected from among tertiary octyl, t-dodecyl, di-t-dodecyl, t-butyl and di-t-butyl.

Examples of aromatic amines include mono-tertiary-alkyl-diarylamines, di-tertiaryoctyl diphenylamine, di-alkyl-diarylamines, diphenylamine, 4-tertiarypentyl-diphenylamine, N-p-tertiary pentyl-pheyl-alpha-naphthylamine, beta-4-tertiary-octyl-phenyl-alpha naphthylamine, N-p-(1:1:3:3:-tetramethylbutyl)alpha-naphthylamine, 4-p-(1:1:3:3:-tetramethylbutyl)diphenylamine, phenyl-alpha-naphthylamine and phenyl-beta-naphthylamine.

Preferred aromatic amines include diphenylamine and phenyl-alpha-naphthylamine and their alkylated derivatives.

The preferred alkanolamine is triethanolamine.

The preferred aminomethane is tris(hydroxy-methyl-)amino-methane.

Preferred hindered alcohols of the formulas (IV)-(VIII) include pentaerythritol, trimethylolpropane, dipentaerythritol, trimethylol ether, trimethyl-1,3-pentanediol, neopentyl glycol and trimethylolbutane.

The reactants, i.e., the succinic compound, the aromatic amine and the hindered alcohol can be made by any method known to the art or obtained from suitable commercial sources.

The reactions by which the products in accordance with the invention are obtained can, broadly, be carried out over a wide range of conditions of from about 50° C. to about 300° C. in from about 0.5 hour to about 10 hours, depending on temperature and reactivity of the reactants, and at atmospheric or elevated pressures. The temperature of reaction can be from about 50° C. to about 250° C. and preferably is from about 100° C. to about 200° C. for the reaction between the alkenylsuccinic compound and the arylamine. When carrying out the reaction of the alkenylsuccinic-diarylamine product with the aminomethane or alkanolamine, the temperature will generally be from about 100° C. to about 300° C., preferably about 150° C. to about 275° C. Times will run from about 1 hour or less to about 10 hours. When carrying out the reaction of the alkenylsuccinic-arylamine product and the hindered alcohol, the temperature will generally be from about 100° C. to about 300° C., preferably about 125° C. to about 275° C. and reaction times will run from about 1 hour or less to about 10 hours.

The reactants can be used in the range of about 0.1 to about 1.0 mole of arylamine per 1.0 mole of alkenylsuccinic compound and from about 0.1 to 1.2 moles of alkanolamine or aminomethane or about 0.5 to 1 mole of hindered alcohol per 1.0 mole of alkenylsuccinic compound. The preferred amounts of reactants are 1.0 mole of alkenylsuccinic compound, 1.0 mole of arylamine and no more than about 0.6 mole of alkanolamine or aminomethane and about 0.75 mole of hindered alcohol.

The alkenyl group of the alkenylsuccinic compound, preferably the anhydride or the acid, substituted or unsubstituted, can have a number average molecular weight of from about 360 to about 1800, i.e., it will preferably have from about 30 to 150 carbon atoms.

The reaction is generally carried out by first reacting the alkenylsuccinic compound and the aromatic amine followed by reacting the product thereof with the alkanolamine, aminomethane or hindered alcohol. However, any convenient method known to the art may be used.

While the reaction sequence has been disclosed to be reaction of (1) alkenylsuccinic compound and diarylamine and (2) reaction of (1) with an alkanolamine, the invention is not limited to that method. For example, the alkanolamine may be reacted with the alkenylsuccinic compound, followed by reaction of the product thus obtained with the diarylamine. The same times and temperatures mentioned above for reactions involving diarylamine or alkanolamine will generally apply in such reactions. Furthermore, all reactants can be mixed and reacted in one step, in which case the temperature again can be from about 50° C. to about 300° C. and the time from about 0.5 hour to about 10 hours.

The unborated reaction products of the present invention can be borated by reaction with a boron compound such a boric acid, boric oxide, an alkyl borate or mixtures of these. Boric acid is preferably reacted with an excess of an alcohol to form an alkyl borate which reacts with the unborated reaction product to form a borated reaction product. Alcohols such as lower alkanols, e.g., methanol, ethanol, propanol, butanol, pentanol, etc., are especially useful. Approximately one mole of unborated reaction product is reacted with between 1/5 to 1 mole of boron compound, preferably about ⅓ mole of boron compound.

The reaction to form the borated product can be carried out at from about 80° C. to about 260° C., preferably from about 110° C. to about 120° C. The temperature chosen will depend for the most part on the particular reactants and on whether or not a solvent is used. Reaction pressures can be vacuum, atmospheric or positive pressure.

The products of the invention are used in minor dispersant or anticorrosion amounts with a major proportion of a lubricating oil or grease or other solid lubricant or fuel. In general, this will amount to from about 0.05% to about 15% by weight of the total composition. Furthermore, other additives, such as other detergents, antioxidants, antiwear agents and the like may be compatibly used therein for their known purposes. These additives can include phenates, sulfonates, succinimides, zinc dithiophosphates, polymers, calcium and magnesium salts and the like.

The lubricants contemplated for use with the products herein disclosed include mineral and synthetic oils of lubricating viscosity, mixtures of mineral oils, mixtures of synthetic oils and mixtures of mineral and synthetic oils. The synthetic hydrocarbon oils include long-chain alkanes such as cetanes and olefin polymers such as oligomers of hexane, octene, decene, and dodecene, etc. The products of this invention are especially effective in synthetic oils formulated using mixtures of synthetic hydrocarbon olefin oligomers and lesser amounts of hydrocarbyl carboxylic ester fluids. Other synthetic oils, which can be mixed with a mineral or synthetic hydrocarbon oil, include (1) fully esterified ester oils, with no free hydroxyls, such as pentaerythritol esters of monocarboxylic acids having 2 to about 20 carbon atoms, trimethylolpropane esters of monocarboxylic acids having 2 to about 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, di- and tripentaerythritol or mixtures thereof with an aliphatic monocarboxylic acid containing from 1 to about 20 carbon atoms, or mixtures of such acids.

As hereinbefore indicated, the aforementioned additives can be incorporated into grease compositions. When high temperature stability is not a requirement of the finished grease, mineral oils having a viscosity of at least 40 SSU at 150° F. are useful. Otherwise those falling within the range of from about 60 SSU to about 6,000 SSU at 100° F. may be employed. The lubricating compositions of the present invention, containing the above-described additives, are combined with a grease-forming quantity of a thickening agent. For this purpose, a wide variety of materials can be dispersed in the lubricating oil in such degree as to impart to the resulting grease composition the desired consistency. For example soap thickeners, e.g., calcium and lithium soaps may be used. Non-soap thickeners, such as surface-modified clays and silicas, aryl ureas, calcium complexes and similar materials may also be used. In general, grease thickeners are employed which do not melt or dissolve when used at the required temperature within a particular environment, however, in all other respects, any material which is normally employed in thickening or gelling oleaginous fluids or forming greases may be used in the present invention.

These additives as mentioned hereinabove are also contemplated for use in liquid hydrocarbyl fuels such as various distillates, diesel fuel and gasoline.

Having described the invention with reference to its broader aspects, the following are offered to specifically illustrate it. It will be understood that the Examples are for illustration only and are not intended to limit the scope of the invention.

EXAMPLE 1

A mixture of 676 grams (0.48 mol) of polybutenylsuccinic anhydride and 105 grams (0.48 mol) of phenyl-alpha-naphthylamine was stirred at 160° C. for about three hours. The reaction mixture was then cooled to about 100° C. and 50 grams (0.34 mol) of triethanolamine were added. The mixture was then stirred to about 265° C. over a six hour period using a stream of nitrogen to remove water formed during the reaction. The final product was obtained by filtration.

EXAMPLE 2

A mixture of 1800 grams (1.0 mol) of polybutenylsuccinic anhydride and 169 grams (1.0 mol) of diphenylamine was stirred for three hours at 160° C., then allowed to cool to 75° C. At this point, 121 grams (1 mol) of tris(hydroxymethyl)-aminomethane were added and the mixture stirred to 250° C. over a six hour period. After blowing with nitrogen, the final product was obtained by filtration.

EXAMPLE 3

A mixture of 1800 grams (1.0 mol) of polybutenylsuccinic anhydride and 169 grams (1.0 mol) of diphenylamine was stirred for three hours at 160° C. After cooling to 100° C., 112 grams (0.75 mol) of triethanolamine were added and the mixture stirred to 225° C. over a six hour period. After blowing with nitrogen, the final product was obtained by filtration.

EXAMPLE 4

A commercial dispersant.

EXAMPLE 5

A mixture of 1800 grams (1.0 mol) polybutenyl succinic anhydride and 169 g (1.0 mol) diphenylamine was stirred at about 170° C. for three hours. After cooling to about 120° C., 105 g (0.7 mol) of commercial pentaerythritol) (a mixture of mono- and dipentaerythritol) were added to the mixture and stirred at about 250° C. over a six hour period. The final product was obtained by blowing with nitrogen and filtering.

EXAMPLE 6

A mixture of 1800 grams (1.0 mol) polybutenyl-succinic anhydride and 169 g (1.0 mol) diphenylamine was stirred at about 170° C. for three hours. After cooling to 125° C., 100.5 g (0.75 mol) trimethylolpropane were added and the mixture stirred to 250° C. over a six hour period. The final product was obtained by blowing with nitrogen and filtering.

EXAMPLE 7

A polybutenylsuccinimide commercial dispersant.

EXAMPLE 8

A commercial dispersant derived from polybutenylsuccinic anhydride, pentaerythritol, and a polyethylene polyamine.

EXAMPLE 9

A mixture of 300 grams of the reaction product of Example 2, 25 grams of boric acid and 35 grams of n-butanol was heated at 100° C. for 2 hours. The reaction mixture was subjected to a vacuum to remove water. The final product was obtained by filtration.

EXAMPLE 10

A mixture of 300 grams of the reaction product of Example 3, 25 grams of boric acid and 35 grams of n-butanol was heated at 100° C. for 2 hours. The reaction mixture was subjected to a vacuum to remove water. The final product was obtained by filtration.

EXAMPLE 11

A mixture of 300 grams of the reaction product of Example 5, 25 grams of boric acid and 35 grams of n-butanol was heated at 100° C. for 2 hours. The reaction mixture was subjected to a vacuum to remove water. The final product was obtained by filtration.

EXAMPLE 12

A mixture of 300 grams of the reaction product of Example 6, 25 grams of boric acid and 35 grams of n-butanol was heated at 100° C. for 2 hours. The reaction mixture was subjected to a vacuum to remove water. The final product was obtained by filtration.

EVALUATION OF PRODUCTS

The products of this invention were tested in lubricating oils in the 1-G Caterpillar engine test, the conditions of which were as follows:

An oil composition consisting of a blend of solvent refined mineral oils (KV at 210° F. (98.9° C.) of 11 cs) was used as the base fluid. To this was added 4.2% by weight (pure basis) of the additives of Examples 1 through 8.

The test engine was a single cylinder 4-cycle Caterpillar engine operated under the following conditions:

| | |
|---|---|
| Speed, RPM | 1000 |
| Brake Load, HP | 19.8 |
| Oil Temperature, °F. | 150 (65.6° C.) |
| Jacket Temperature, °F. | 150 (65.6° C.) |
| Fuel | Diesel fuel containing 1 percent sulfur |

The engine is operated for 480 hours, ratings being made after 240 hours and 480 hours. These ratings are made in accordance with the Coordinating Research Council rating system for diesel pistons. With this system O is clean and the maximum piston density allowed is 17,450.

All percentages were by weight. The following results were obtained:

TABLE

| | Caterpillar 1-6 Test* | | |
|---|---|---|---|
| Example No. | Conc. Wt. % | Top Groove Packing | Weighted Total Demerits |
| 1 | 4.2 | 3.0 | 130.1 |
| 2 | 4.2 | 12.0 | 120.0 |
| 3 | 4.2 | 2.0 | 58.0 |
| 4 (a commercial dispersant) | 4.2 | 75.0 | 152.0 |
| 5 | 4.2 | 9.0 | 211.0 |
| 6 | 4.2 | 35.0 | 270.0 |
| 7 | 4.2 | 120.0 | 360.0 |
| 8 | 4.2 | 35.0 | 250.0 |

*The test procedure is additionally described in U.S. Pat. No. 4,292,186. The base oil composition comprises a blend of solvent refined mineral oils containing overbased calcium sulfonate, overbased calcium phenate, normal calcium sulfonate, zinc dithiophosphate and a hindered phenol antioxidant. The test results clearly show the excellent dispersant properties of additive products prepared in accordance with the invention.

What is claimed is:

1. A product of reaction made by (a) reacting (i) an alkenylsuccinic compound with (ii) a secondary amine of the formula:

$$\text{ANHB} \qquad \text{(I)}$$

wherein A and B, which may be the same or different, are each independently an aromatic group or an alkyl substituted aromatic group, and (b) reacting the product of step (a) with (iii) a compound selected from the group consisting of an alkanolamine of the formula:

$$(HOR^1)_xN(H)_y \qquad \text{(II)}$$

wherein $R^1$ is an alkylene group having 1 to 6 carbon atoms, x is 1 to 3 and y is 0 to 2, the sum of x and y being 3, an aminomethane of the formula:

$$(HOR^2)_{x'}C(H)_{y'}NH_2 \qquad \text{(III)}$$

wherein $R^2$ is the same as $R^1$ and x' and y' have the same meaning as x and y, respectively, and a hindered alcohol selected from the group having the following general formulae:

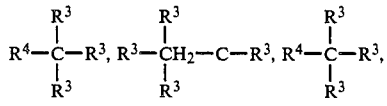

(IV) (V) (VI)

-continued

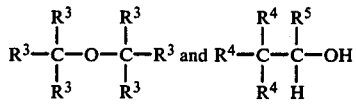

(VII) (VIII)

wherein $R^3$ and $R^4$ are each selected from CHOH, $CH_2OH$, and $CH_3$ and $R^5$ is selected from H or an alkyl group of from about 4 to 22 carbon atoms and wherein reaction (a) is carried out at temperatures from about 100°-200° C. and reaction (b) is carried out at temperatures of from about 100° to about 300° C. with the reactants being present in a molar ratio of alkenylsuccinic compound to secondary amine to alkanolamine or aminomethane of about 1:0.1-1:0.1-1.2 or alkenylsuccinic compound to secondary amine to hindered alcohol of about 1:0.1-1:0.5-1.

2. The product of claim 1, wherein the hindered alcohol is trimethylolpropane.

3. The product of claim 1, wherein the hindered alcohol is pentaerythritol.

4. The product of claim 1, wherein the alkanolamine is triethanolamine.

5. The product of claim 1, wherein the succinic compound is polybutenylsuccinic anhydride.

6. A borated reaction product of claim 1.

7. A composition comprising a major proportion of an oil of lubricating viscosity or grease prepared therefrom and a minor effective dispersant or antioxidant amount of the product as prepared and described in any one of claims 1 to 6.

8. The composition of claim 7, wherein the product of reaction is present in an amount of from about 0.05 to about 15% by weight of the total composition.

9. The composition of claim 7, wherein the oil of lubricating viscosity is a mineral oil.

10. The composition of claim 7, wherein the oil of lubricating viscosity is a synthetic oil.

11. The composition of claim 7, wherein the oil of lubricating viscosity is a mixture of mineral and synthetic oil.

12. The composition of claim 7, comprising a major proportion of a grease and a minor proportion of said product.

13. The product of claim 1 wherein reaction (b) is carried out prior to reaction (a).

14. The product of claim 1 wherein all reactants are mixed in said molar ratios and reacted in one step at temperatures of about 50° to about 300° C.

15. A product of reaction made by (a) reacting (i) an alkenylsuccinic compound with (ii) a secondary amine of the formula:

(I)

wherein A and B, which may be the same or different, are each independently an aromatic group or an alkyl substituted aromatic group, and (b) reacting the product of step (a) with (iii) a compound selected from the group consisting of an alkanolamine of the formula:

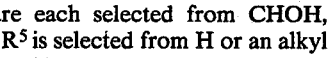

(II)

wherein $R^1$ is an alkylene group having 1 to 6 carbon atoms, x is 1 to 3 and y is 0 to 2, the sum of x and y being 3, an aminomethane of the formula:

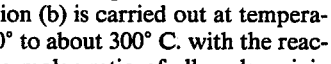

(III)

wherein $R^2$ is the same as $R^1$ and x' and y' have the same meaning as x and y, respectively, and a hindered alcohol selected from the group having the following general formulae:

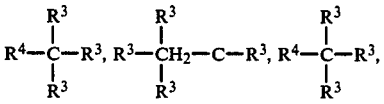

(IV) (V) (VI)

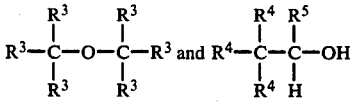

(VII) (VIII)

wherein $R^3$ and $R^4$ are each selected from CHOH, $CH_2OH$, and $CH_3$ and $R^5$ is selected from H or an alkyl group of from about 4 to 22 carbon atoms and wherein reaction (a) is carried out at temperatures from about 100°-200° C. and reaction (b) is carried out at temperatures of from about 100° to about 300° C. with the reactants being present in a molar ratio of alkenylsuccinic compound to secondary amine to alkanolamine or aminomethane of about 1:0.1-1:0.1-1.2 or alkenylsuccinic compound to secondary amine to hindered alcohol of about 1:0.1-1:0.5-1 and wherein the product of reaction (b) is reacted with from about 0.2 to 1 mole of a suitable boron compound at temperatures of from about 80° to about 260° C.

16. The product of claim 15 wherein reaction (b) is carried out prior to reaction (a).

17. The product of claim 15 wherein all reactants are mixed in said molar ratios and reacted in one step at temperatures of about 50° to about 300° C.

* * * * *